US007343118B2

(12) United States Patent
Ahn et al.

(10) Patent No.: US 7,343,118 B2
(45) Date of Patent: Mar. 11, 2008

(54) DOOR SHOCK ABSORBER AND IMAGE FORMING APPARATUS EMPLOYING THE SAME

(75) Inventors: Byeong-hwa Ahn, Seongnam-si (KR); Heung-sup Jeong, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 322 days.

(21) Appl. No.: 11/175,444

(22) Filed: Jul. 7, 2005

(65) Prior Publication Data

US 2006/0120756 A1 Jun. 8, 2006

(30) Foreign Application Priority Data

Dec. 2, 2004 (KR) ..... 10-2004-0100347

(51) Int. Cl.
*G03G 21/16* (2006.01)
*E05F 11/24* (2006.01)
*E05F 1/10* (2006.01)

(52) U.S. Cl. ..... 399/124; 49/346; 49/386; 292/DIG. 15

(58) Field of Classification Search ..... 399/107, 399/124; 292/DIG. 15; 16/286, 54, 50; 49/346, 386, 387
See application file for complete search history.

(56) References Cited

U.S. PATENT DOCUMENTS 2,605,494 A * 8/1952 Lyons, Jr. et al. ..... 49/386
2,686,340 A * 8/1954 Davis, Jr. et al. ..... 49/386
3,367,066 A * 2/1968 Slusser, Jr. ..... 49/386
4,167,298 A * 9/1979 Plattner ..... 49/386
4,607,870 A * 8/1986 Crisp et al. ..... 292/DIG. 15
4,658,473 A * 4/1987 Schema ..... 16/286
4,734,748 A * 3/1988 Murayama et al. ..... 399/124
5,450,651 A * 9/1995 Coleman et al. ..... 49/346
5,590,920 A * 1/1997 Anderson et al. .... 292/DIG. 15
6,442,799 B1 * 9/2002 Duarte et al. ..... 16/286
6,568,035 B2 * 5/2003 Zetti ..... 16/286

FOREIGN PATENT DOCUMENTS

| | | |
|---|---|---|
| JP | 05-323686 | 12/1993 |
| JP | 08-101466 | 4/1996 |
| KR | 1994-0001005 | 2/1994 |
| KR | 1994-0009666 | 5/1994 |
| KR | 1998-0067214 | 10/1998 |
| KR | 20-0168094 | 11/1999 |

* cited by examiner

*Primary Examiner*—Susan Lee
(74) *Attorney, Agent, or Firm*—Roylance, Abrams, Berdo & Goodman, L.L.P.

(57) ABSTRACT

A door shock absorber is provided to absorb noise and shock when a door is opened, and an image forming apparatus employing the same. The door shock absorber includes a first guide rail included in a door mounted on a case used as an outer covering. A first spring is contained by the first guide rail. A link has a first end hingedly connected to the inside of the case, and a second end connected to the first guide rail and able to move in the direction of the first guide rail. When the door is opened, the second end of the link moves in the direction of the first guide rail and compresses the first spring.

20 Claims, 7 Drawing Sheets

DOOR SHOCK ABSORBER AND IMAGE FORMING APPARATUS EMPLOYING THE SAME

CROSS REFERENCE TO RELATED APPLICATION

This application claims the benefit under 35 U.S.C. § 119(a) of Korean Patent Application No. 10-2004-0100347, filed on Dec. 2, 2004, in the Korean Intellectual Property Office, the entire disclosure of which is hereby incorporated by reference.

BACKGROUND OF THE INVENTION

1. Field of the Invention

The present invention relates to a door shock absorber to absorb noise and shock when a door is opened, and an image forming apparatus employing the same.

2. Description of the Related Art

Image forming apparatus, such as printers and copiers, form an image on a sheet of paper. Internal components of the image forming apparatus, such as a laser scanning unit, a developing unit, and a transfer belt unit, are mounted in a case. The case has one or more doors for allowing access to the internal components or removing jammed paper.

FIGS. 1 and 2 are cross sectional views illustrating a door included in a conventional image forming apparatus, in which FIG. 1 illustrates the door closed and FIG. 2 illustrates the door open. Referring to FIGS. 1 and 2, a door 10 included in the case 1 of the image forming apparatus opens and closes around a first hinge axis 13 at the bottom of the case 1. A door bracket 12 at the bottom of the door 10 is hinged to a frame (not shown) inside the image forming apparatus. The door 10 includes a guide rail 15 inside the door 10 and a link 20 connected to the guide rail 15, which are used to control the opening angle of the door 10. The link 20 pivots around a second axis 22 at which one end 21 of the link 20 is hinged to the frame inside the image forming apparatus. A boss 25 projecting from the other end of the link 20 is inserted in a guide slot 16 formed on the guide rail 15 to slide along the guide slot 16.

When the door 10 is opened, the door 10 pivots clockwise around the first hinge axis 13, and the link 20 pivots clockwise around the second hinge axis 22, while the boss 25 slides from a first end 17 to a second end 18 of the guide slot 16. Referring to FIG. 2, when the moving boss 25 stops at the second end 18 of the guide slot 16, the door 10 is prevented from pivoting further around the first hinge axis 13, thus controlling the opening angle of the door 10.

However, a loud noise is caused when the boss 25 of the link 20 strikes the second end 18 of the guide rail 15, unless the door 10 is slowly opened by hand.

The door 10 may support the weight of one of the internal components of the image forming apparatus, such as the transfer belt unit. In this case, when the door 10 is opened, the extra weight can damage the link 20 and the guide rail 15 when they collide.

Accordingly, a need exists for an improved door shock absorber for an image forming apparatus.

SUMMARY OF THE INVENTION

The present invention provides a door shock absorber used to absorb noise and shock when a door is opened, and an image forming apparatus employing the same.

According to an aspect of the present invention, a door shock absorber includes a first guide rail included in a door mounted on a case used as an outer covering. A first spring is contained in the first guide rail. A link has one end hinged to the inside of the case, and the other end connected to the first guide rail and able to move in the direction of the first guide rail. When the door is opened, the other end of the link moves in the direction of the first guide rail, and elastically compresses the first spring.

The first guide rail may further include a first stopper that controls the movement of the other end of the link when the door is opened.

The first guide rail may further include a projection that allows the other end of the link to move back only when the pressure applied when the door is closed is higher than a predetermined level.

The door shock absorber further include a second guide rail included in the case connected to one end of the link and able to pivot and move in the direction of the second guide rail. A second spring is contained by the second guide rail. When the door is opened, one end of the link moves in the direction of the second guide rail, and elastically compresses the second spring.

The link may include a boss on one end of the link that includes a first diameter and a second diameter smaller than the first diameter, and is inserted in the second guide rail and able to move along the second guide rail. The second guide rail includes a storing unit for storing the boss of the link on one side thereof. When the door is opened, the boss pivots in the storing unit and moves in the direction of the second guide rail while the first diameter is out of the storing unit.

The second guide rail may extend along a circular arc around a pivot axis of the door.

The second guide rail may further include a second stopper that controls the movement of one end of the link when the door is opened.

According to another aspect of the present invention, an image forming apparatus includes a case including a door, and means for forming an image inside the case. A door shock absorber absorbs noise and shock when the door is opened. The door shock absorber includes a first guide rail included in the door, and a first spring contained in the first guide rail. A link has one end hinged to the inside of the case and the other end connected to the first guide rail and able to move in the direction of the first guide rail. When the door is opened, the other end of the link moves in the direction of the first guide rail, and elastically compresses the first spring.

The first guide rail may further include a first stopper that controls the movement of the other end of the link when the door is opened.

The first guide rail may further include a projection that allows the other end of the link to move back only when the pressure applied when the door is closed is higher than a predetermined level.

The door shock absorber may further include a second guide rail included in the case connected to one end of the link and able to pivot and move in the direction of the second guide rail. A second spring is contained in the second guide rail. When the door is opened, one end of the link moves in the direction of the second guide rail, and elastically compresses the second spring.

The link may include a boss on one end of the link that has a first diameter and a second diameter smaller than the first diameter. The boss is inserted in the second guide rail and able to move along the second guide rail. The second guide rail includes a storing unit for storing the first diameter of the boss on one side of the link. When the door is opened, the boss pivots in the storing unit and moves in the direction of the second guide rail when the first diameter moves out of the storing unit.

The second guide rail may extend along a circular arc around a pivot axis of the door.

The second guide rail may further include a second stopper that controls the movement of one end of the link when the door is opened.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above and other features and advantages of the present invention will become more apparent by describing in detail exemplary embodiments thereof with reference to the attached drawings, in which:

FIGS. 1 and 2 are cross sectional views illustrating a door included in a conventional image forming apparatus, in which FIG. 1 illustrates the door closed, and FIG. 2 illustrates the door open;

FIGS. 5 through 7 are diagrams illustrating the operation of the door shock absorber of FIG. 4, in which FIG. 5 illustrates the door closed, FIG. 6 illustrates the door half open, and FIG. 7 illustrates the door open.

Throughout the drawings, like reference numerals will be understood to refer to like parts, components and structures.

DETAILED DESCRIPTION OF EXEMPLARY EMBODIMENTS

The present invention is described below with reference to the accompanying drawings, in which exemplary embodiments of the invention are shown.

Figure 1:
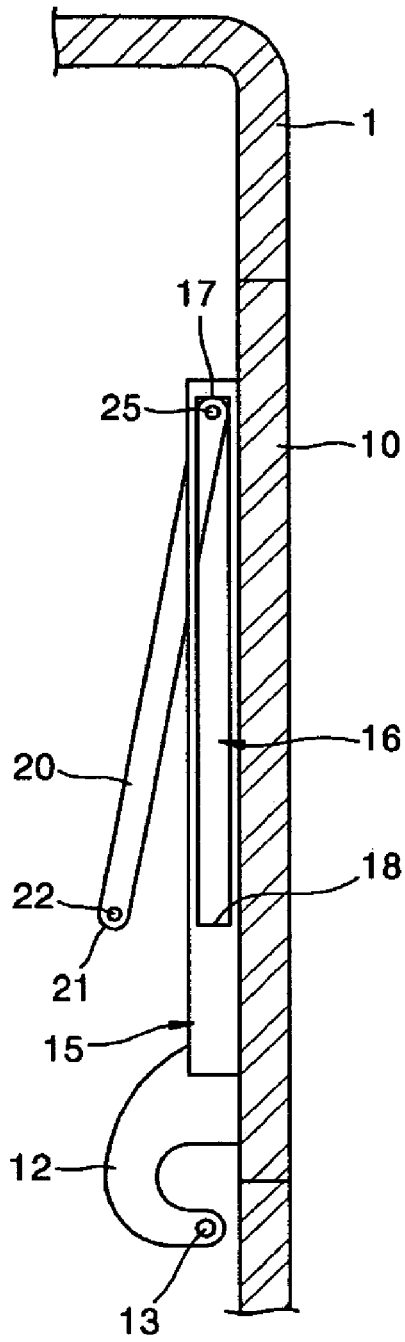
FIG. 1 (PRIOR ART)
Figure 2:
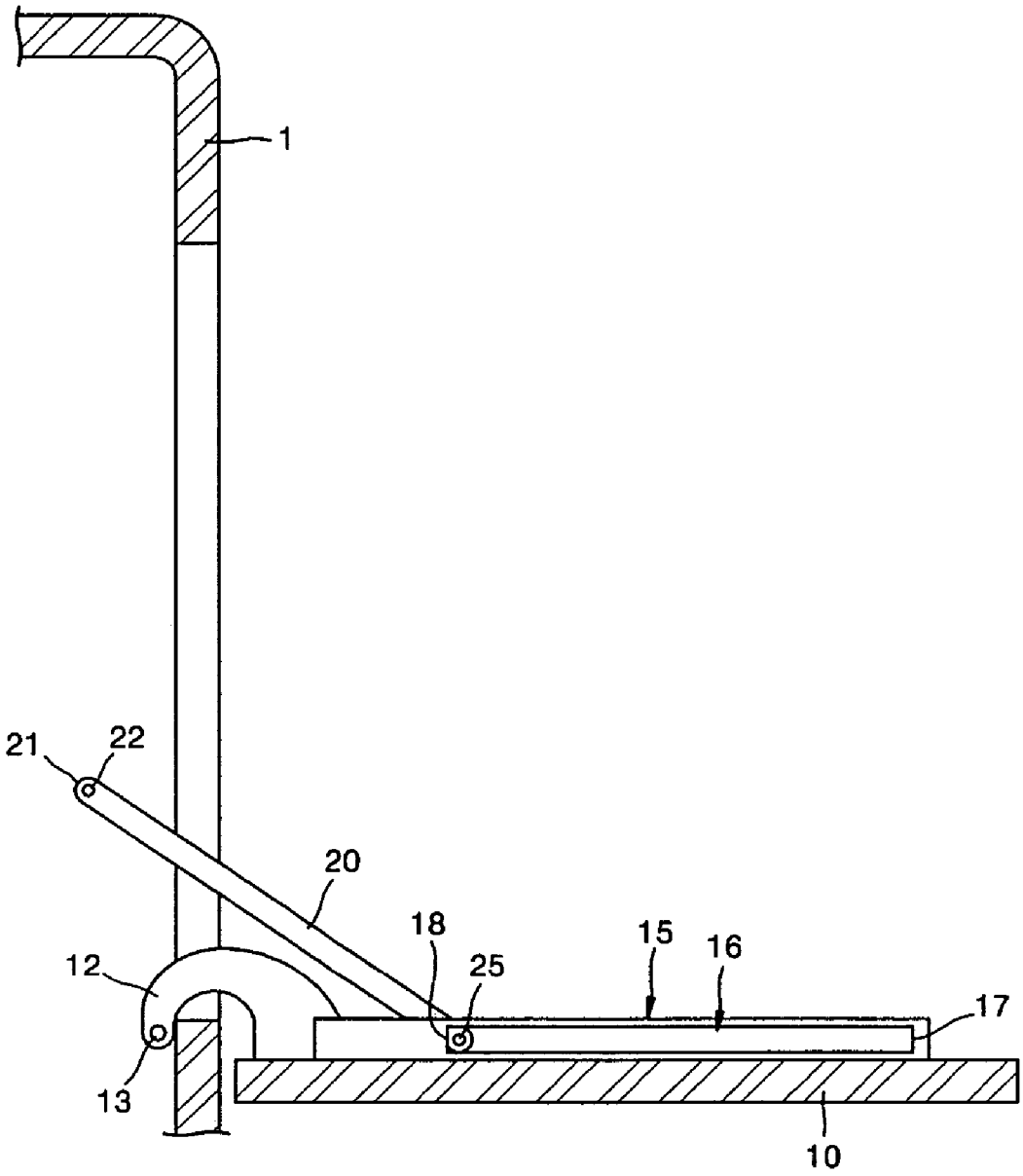
FIG. 2 (PRIOR ART)
Figure 3:
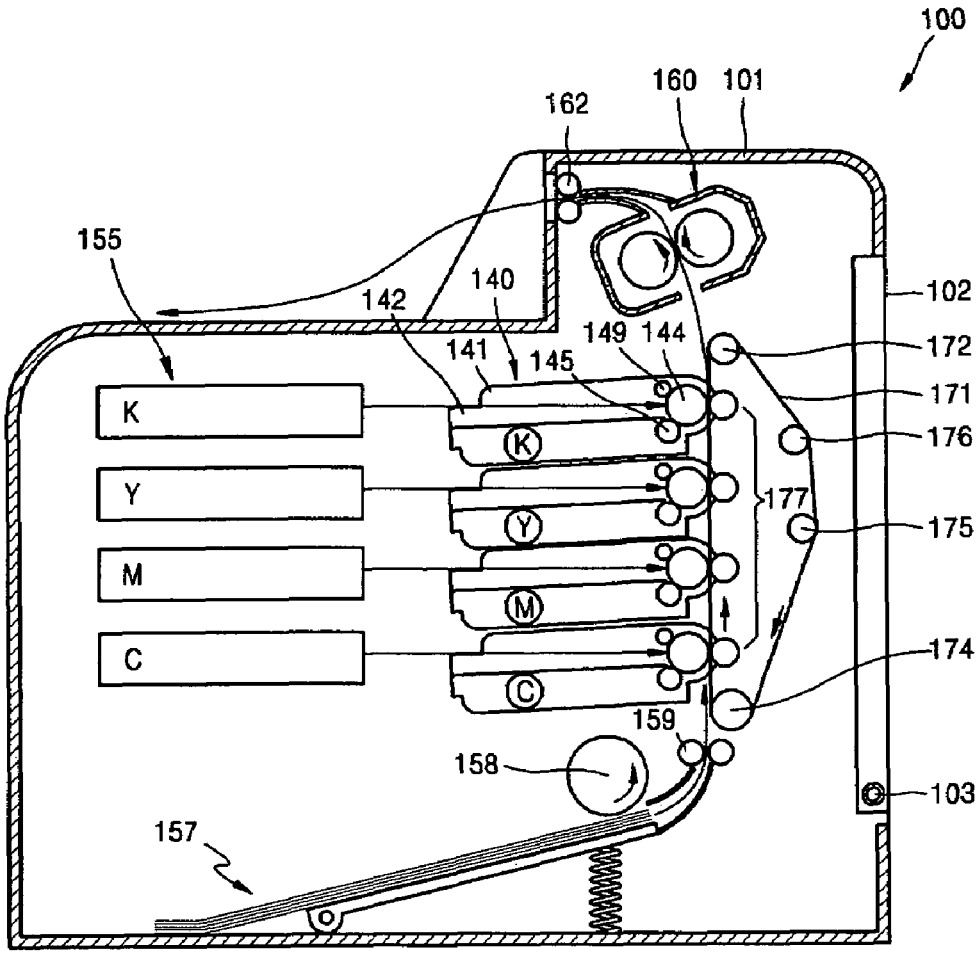
FIG. 3 is a schematic cross sectional view of an image forming apparatus according to an exemplary embodiment of the present invention.
Figure 4:
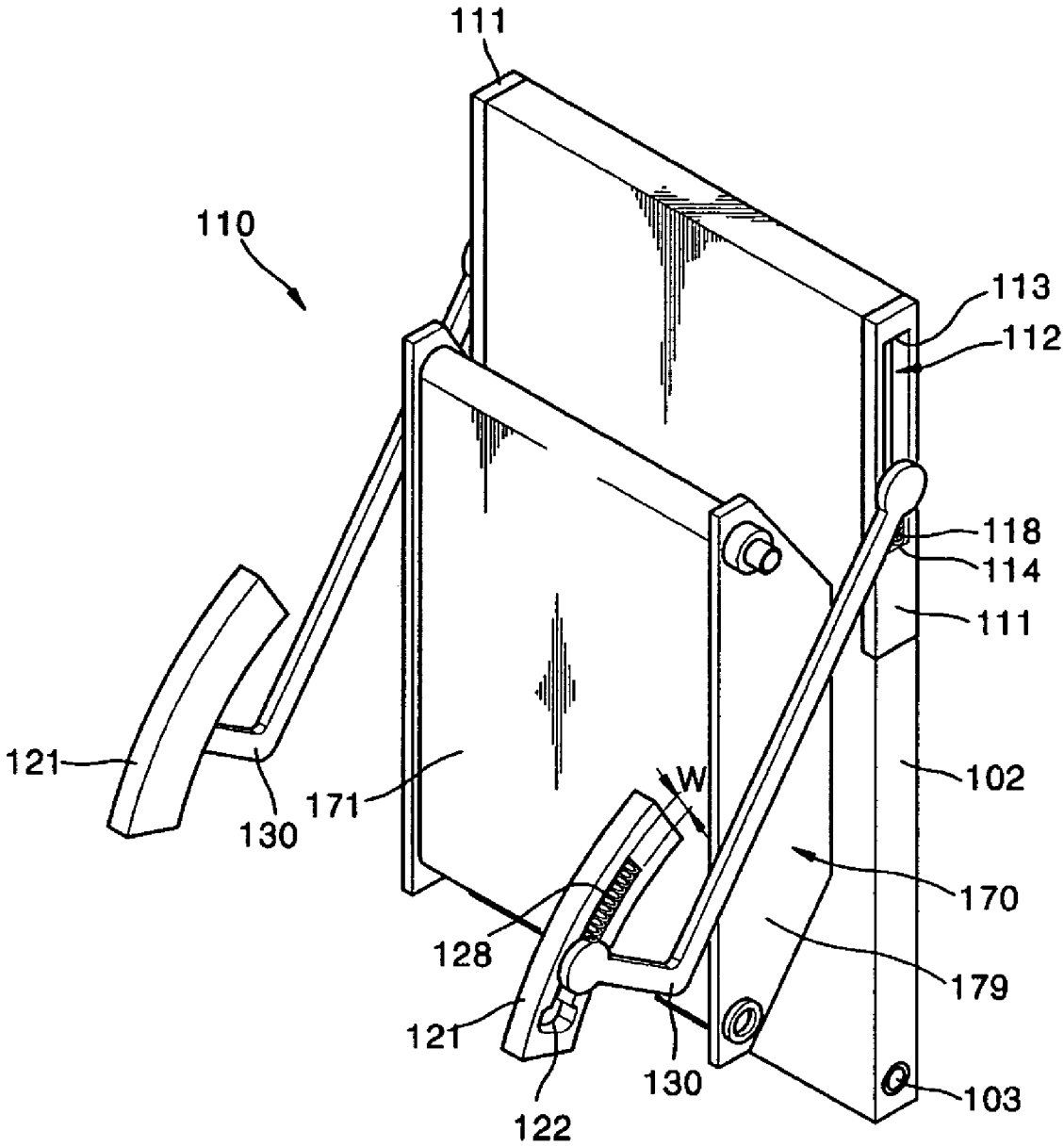
FIG. 4 is a perspective view of a door and a door shock absorber of the image forming apparatus of FIG. 3 according to an exemplary embodiment of the present invention.
Figure 5:
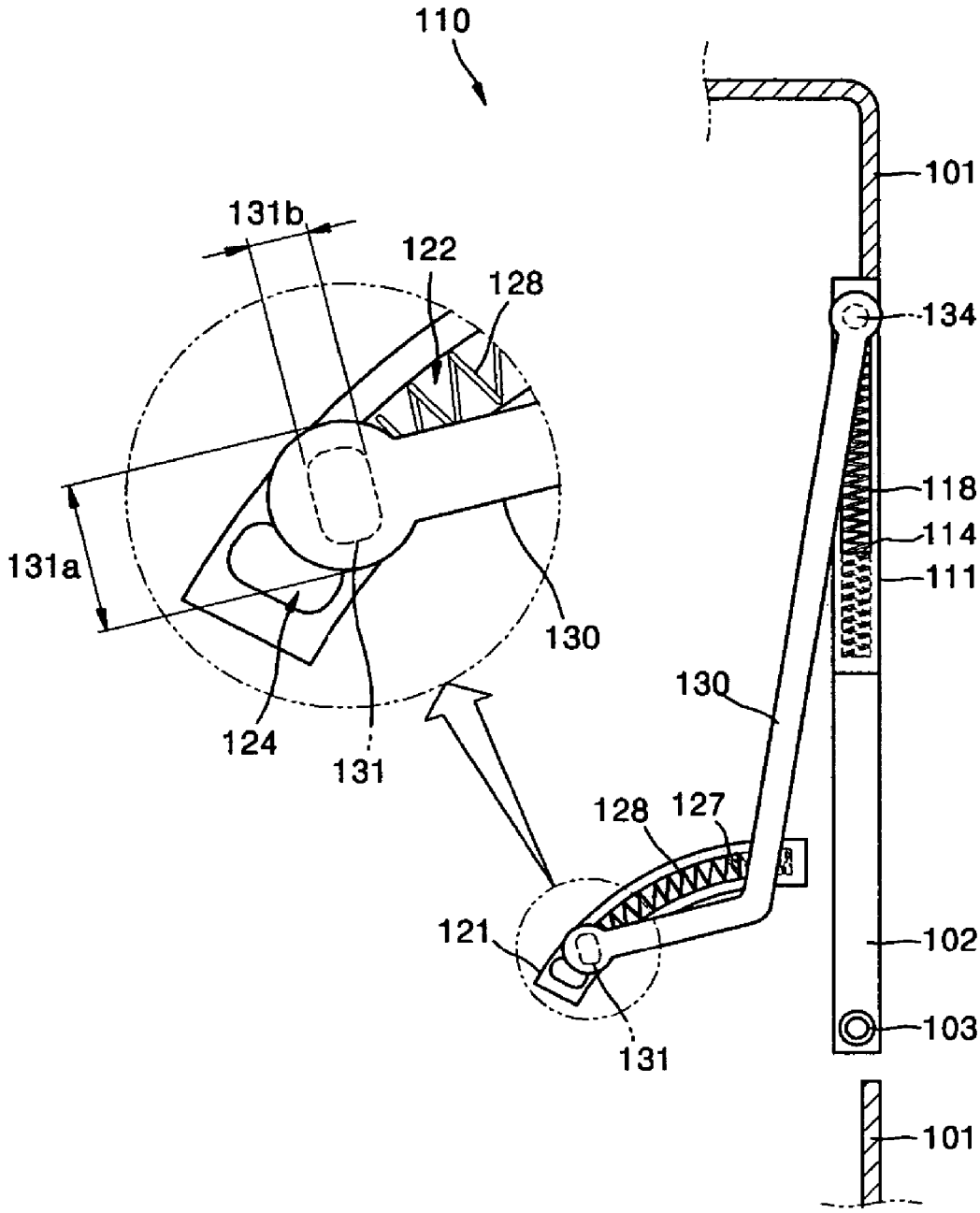
Figure 6:
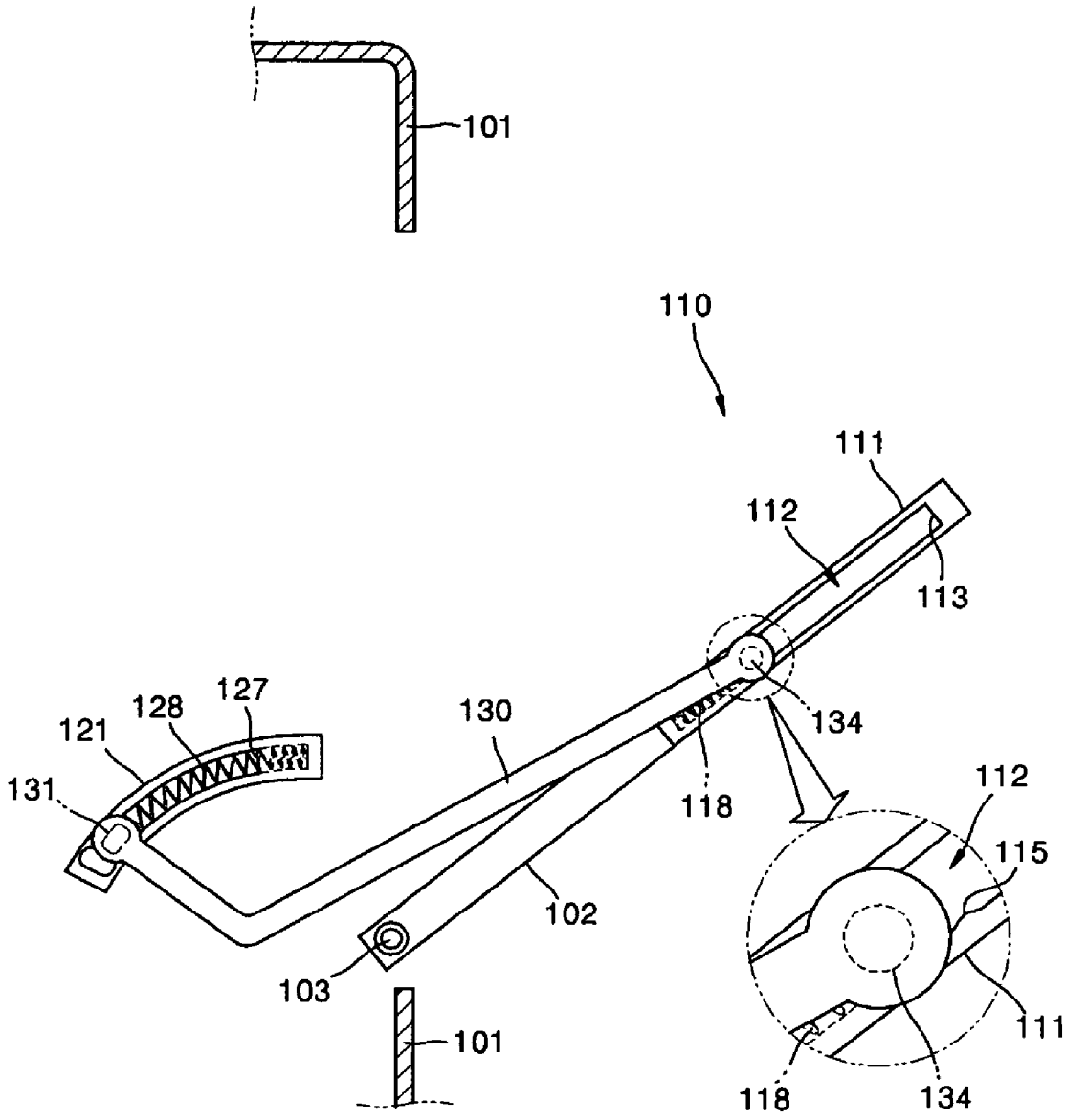
Figure 7:
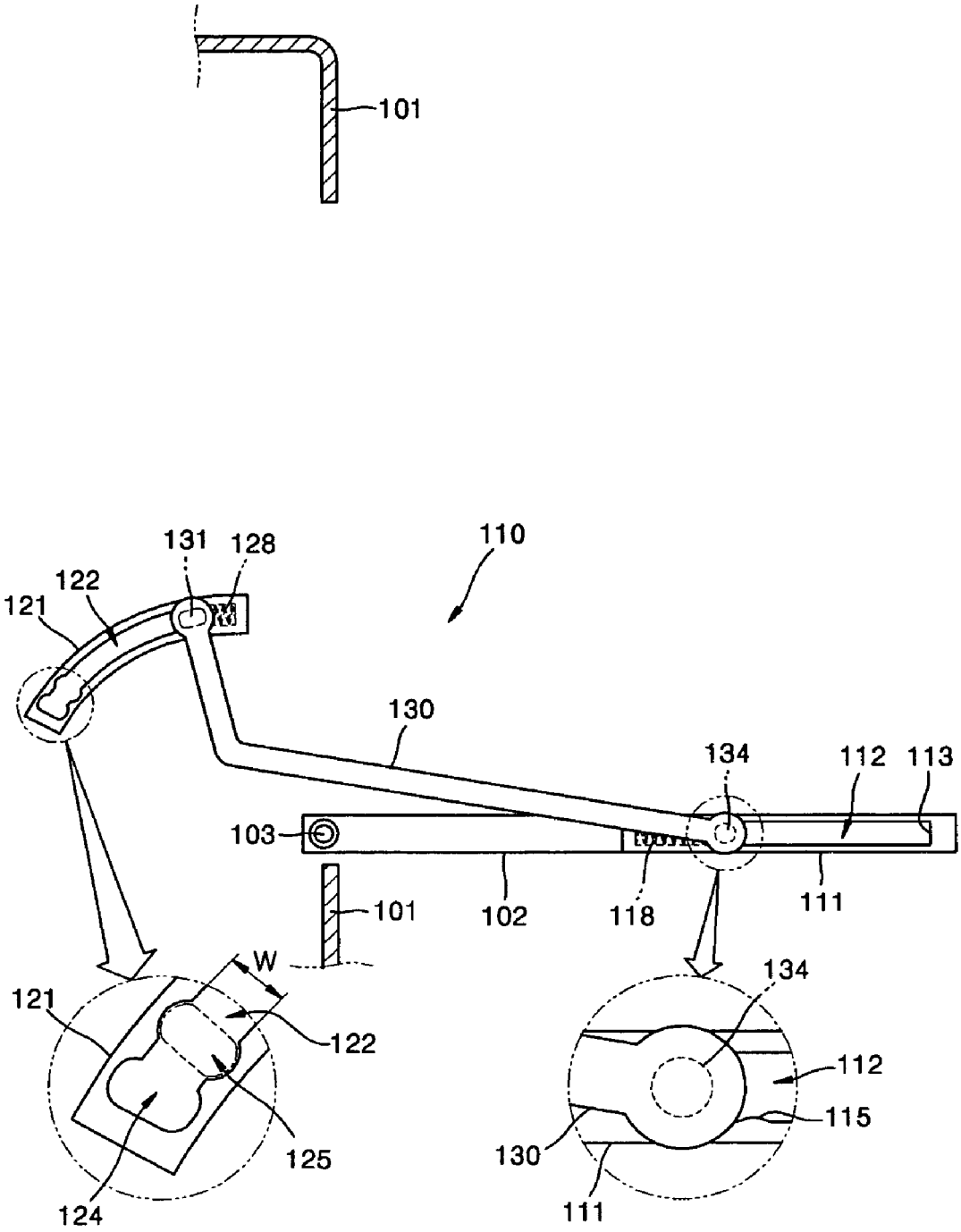

FIG. 3 is a schematic cross sectional view illustrating an image forming apparatus 100 according to an exemplary embodiment of the present invention. FIG. 4 is a perspective view illustrating a door and a door shock absorber 110 of the image forming apparatus shown in FIG. 3 according to an exemplary embodiment of the present invention. FIGS. 5 through 7 are diagrams illustrating the operation of the door shock absorber 110 shown in FIG. 4, in which FIG. 5 illustrates the door closed, FIG. 6 illustrates the door half open, and FIG. 7 illustrates the door open.

Referring to FIG. 3, the image forming apparatus 100 is an electrophotographic image forming apparatus, such as a laser printer or digital copier, that scans light on a photosensitive medium charged with an electric potential. An electrostatic latent image is formed, and developed with a developing agent into a visual image. The image is transferred onto a sheet of paper, and fused to the sheet of paper to form an image. The image forming apparatus 100 includes developers 140C, 140M, 140Y, 140K, light scanners 155C, 155M, 155Y, 155K, a transfer belt 171, four transfer rollers 177, and a fuser 160 in the case 101. The image forming apparatus 100 also includes a cassette 157 containing paper, a pick-up roller 158 for picking up the paper from the cassette 157, feed rollers 159 for conveying the paper, and eject rollers 162 for discharging the paper out of the case 101 after printing.

The developer 140 is a single cartridge and includes the developers 140C, 140M, 140Y, and 140K, which contain four different consumable toners, i.e., cyan C, magenta M, yellow Y, and black K, to form a color image, as shown in FIG. 3.

A door 102 on one side of the case 101 pivots around a pivot axis 103. Referring to FIG. 4, the transfer belt 171 and the four transfer rollers 177 are mounted in a housing 179 to form a transfer belt unit 170 that moves with the door 102 as it is opened and closed. When the door 102 is closed, the transfer belt unit 170 moves vertically so that the transfer belt 171 contacts photosensitive media 144C, 144M, 144Y, 144K of the developers 140C, 140M, 140Y, 140K. When the door 102 is opened, the transfer belt unit 170 moves horizontally so that the transfer belt 171 is separated from the photosensitive media 144C, 144M, 144Y, 144K of the developers 140C, 140M, 140Y, 140K. Therefore, the developers 140C, 140M, 140Y, 140K may be replaced with new ones through the door 102 when the toner in the developers 140C, 140M, 140Y, 140K has been consumed. The transfer belt 171 is supported by an operating roller 172 and supporting rollers 174, 175, 176 and circulated in a vertical direction.

In an exemplary embodiment, the light scanners 155C, 155M, 155Y, 155K correspond respectively to the developers 140C, 140M, 140Y, 140K. The light scanners 155C, 155M, 155Y, 155K scan lights corresponding to cyan, magenta, yellow, and black image information onto the photosensitive media 144C, 144M, 144Y, 144K mounted in housings 141C, 141M, 141Y, 141K. A laser scanning unit (LSU) that uses laser diode light source may be used for one of the light scanners 155C, 155M, 155Y, 155K.

The developers 140C, 140M, 140Y, 140K include the photosensitive media 144C, 144M, 144Y, 144K and developing rollers 145C, 145M, 145Y, 145K. A part of the outer surface of the photosensitive media 144C, 144M, 144Y, 144K faces the transfer belt 171 when the image is formed is exposed outside the housings 141C, 141M, 141Y, 141K to transfer the image onto the paper. The developers 140C, 140M, 140Y, 140K respectively comprise four charge rollers 149C, 149M, 149Y, 149K. The charge rollers 149C, 149M, 149Y, 149K are given a charge bias for electrically charging the outer surface of the photosensitive media 144C, 144M, 144Y, 144K.

The developing rollers 145C, 145M, 145Y, 145K supply the toner attached to their outer surface to the photosensitive media 144C, 144M, 144Y, 144K. The developing rollers 145C, 145M, 145Y, 145K are given a developing bias for supplying the toner to the photosensitive media 144C, 144M, 144Y, 144K. Although not shown, the housings 141C, 141M, 141Y, 141K include a toner feed roller that supplies toner to the developing rollers 145C, 145M, 145Y, 145K, a doctor blade that regulates the amount of toner attached to the developing rollers 145C, 145M, 145Y, 145K, and an agitator in the form of a conveyor belt that supplies the toner to the toner feed roller. In an exemplary embodiment, the developers 140C, 140M, 140Y, 140K include openings 142C, 142M, 142Y, 142K to allow the light from the light scanners 155C, 155M, 155Y, 155K to pass through onto the photosensitive media 144C, 144M, 144Y, 144K.

The four transfer rollers 177 are disposed to face each of the photosensitive media 144C, 144M, 144Y, 144K, and the transfer belt 171 is disposed therebetween. The four transfer rollers 177 are given a transfer bias.

The process of forming a color image using the electrophotographic color image forming apparatus 100 is described below.

The charge rollers 149C, 149M, 149Y, 149K having the charge bias are used to uniformly charge the photosensitive media 144C, 144M, 144Y, 144K. The light scanners 155C, 155M, 155Y, 155K produce light corresponding to cyan, magenta, yellow, and black image information, respectively. The light is applied to the charged photosensitive media 144C, 144M, 144Y, 144K through the openings 142C, 142M, 142Y, 142K, respectively, such that an electrostatic latent image is formed on the outer surface of the photosensitive media 144C, 144M, 144Y, 144K. The developing rollers 145C, 145M, 145Y, 145K are given a developing bias. The toner on the developing rollers 145C, 145M, 145Y, 145K is transferred to the outer surface of the photosensitive media 144C, 144M, 144Y, 144K. In this manner, cyan, magenta, yellow, and black images are formed on the outer surfaces of the photosensitive media 144C, 144M, 144Y, 144K.

The pick-up roller 158 picks up paper from the cassette 157. The feed rollers 159 feed the paper to the transfer belt 171. The paper is attached to the surface of the transfer belt 171 by an electrostatic force, so that it is conveyed by the transfer belt 171 without sliding.

A leading end of the paper that is conveyed by being attached to the surface of the transfer belt 171 arrives at a transfer nip facing the transfer roller 177 when a leading end of the visible image of the cyan color formed on the circumferential surface of the photosensitive medium 144C arrives at the transfer nip. At this time, the visible image formed on the photosensitive medium 144C is transferred to the paper when the transfer bias is applied to the transfer roller 177. As the paper continuously moves, a color image is formed thereon by overlapping and sequentially transferring visible images of magenta, yellow, and block colors formed on the circumferential surfaces of the photosensitive media 144M, 144Y, and 144K. The fuser 160 applies heat and pressure to the color image on the paper to securely fix the color image to the paper. The paper is discharged from the case 101 by the eject rollers 162.

Referring to FIGS. 4 through 7, the door shock absorber 110 absorbs noise and shock when the door 102 is opened. First guide rails 111 are disposed on two corners of the door 102. Second guide rails 121 are connected to a frame (not shown) inside the case 101. Links 130 have first ends connected to the second guide rails 121 and second ends connected to the first guide rails 111.

A part of the first guide slots 112 extends in a lengthwise direction of the first guide rails 111. A pair of first springs 118 are contained in the first guide rails 111. A second boss 134 projects from the second end of each link 130 and is inserted into the first guide slots 112 so that the links 130 may be connected to the first guide rails 111. When the door 102 is opened, the second bosses 134 move from the first ends 113 to the second ends 114 of the first guide slots 112, and compress the first springs 118. When the door 102 is closed, the second bosses 134 move from the second ends 114 to the first ends 113 of the first guide slots 112 and release the first springs 118.

The second ends 114 of the first guide slots 112 become first stoppers 114 that control the movement of the second bosses 134. A projection 115 is formed in the path of the second boss 134 around the first stopper 114 in each of the first guide slots 112. The projection 115 controls the movement of the second boss 134, allowing it to move back to the first end 113 of the first guide slot 112 only when the pressure applied to the door 102 is higher than a predetermined level.

The second guide rails 121 extend along a circular arc around the pivot axis 103 of the door 102, and the second guide slots 122 extend along the second guide rails 121. A second spring 128 is contained in each of the second guide rails 121. A first boss 131 projects from a first end of each of the links 130 and is inserted into the second guide slots 122 so that the links 130 may be connected to the second guide rails 121. When the door 102 is opened, the first bosses 131 move from the first ends 124 to the second ends 127 of the second guide slots 122 and compress the second springs 128. When the door 102 is closed, the first bosses 131 moves from the second ends 127 to the first ends 124 of the second guide slots 122 and releas the second springs 128. The second ends 127 of the second guide slots 122 become second stoppers 127 that control the movement of the first bosses 131.

The first boss 131 includes a first diameter 131 a wider than the width W of the second guide slot 122, and a second diameter 131*b* narrower than the width W of the second guide slot 122, and has a sectional shape of a closed figure whose one side is longer than the other side. When the first boss 131 is disposed horizontally in the second guide slot 122 it may move along the second guide slot 122, whereas when it is disposed vertically in the second guide slot 122 it cannot move along the second guide slot 122.

A first boss insertion 124 for inserting the first boss 131 is formed at one end of the second guide slot 122. A storing unit 125 for storing the first diameter 131*a* of the first boss 131 is formed around the first boss insertion 124.

Referring to FIGS. 5 through 7, the operation of the door shock absorber 110 is described. Referring to FIG. 5, when the door 102 is closed, the first boss 131 on one end of the link 130 is stored in the storing unit 125 of the second guide rail 121, and the second boss 134 on the other end of the link 130 is adjacent to the first end 113 of the first guide slot 112. When the door 102 pivots open around the pivot axis 103, the first boss 131 rotates in the storing unit 125 and the second boss 134 moves toward the first stopper 114 in the other end of the first guide slot 112. As a whole, the link 130 pivots around the storing unit 125. The second boss 134 is slowed by the first spring 118 and stops at the first stopper 114 without noise or shock.

Referring to FIG. 6, when the second boss 134 of the link 130 stops at the first stopper 114, the first boss 131 of the link 130 rotates in the storing unit 125 and is disposed horizontally in the second guide slot 122. When the door 102 is opened further, the first boss 131 moves out of the storing unit 125 and toward the other end 127 of the second guide slot 122. The first boss 131 is slowed by the second spring 128 and stops at the second stopper 127 without noise or shock, and the door 102 is fully opened as shown in FIG. 7.

When the door 102 is closed, the second boss 134 of the link 130 cannot move due to the projection 115 of the first guide slot 112, and the first boss 131 of the link 130 moves to the storing unit 125 as shown in FIG. 6. When the door 102 is closed further, the first boss 131 cannot move any more and the link 130 pivots around the storing unit 125. The second boss 134 is pushed over the projection 115 by the closing force applied to the link 130 and moves toward the first end 113 of the first guide slot 112, as shown in FIG. 5.

Although the door shock absorber is described as included in the image forming apparatus, the door shock absorber may be applied to every door included in a case used as an outer covering. Although the door shock absorber is a two-step shock absorber having the pairs of first and second guide rail and the first and second springs, a one-step door shock absorber having only the first guide rail and the first spring may be applied to exemplary embodiments of the present invention.

The door shock absorber and the image forming apparatus employing the same absorb shock when the door is opened, and substantially prevent the door and the link from being damaged. The door shock absorber and the image forming apparatus employing the same also reduce noise caused by the collision of the door and the link, to increase user comfort.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A door shock absorber, comprising:

a first guide rail included in a door mounted on a case used as an outer covering;

a first spring disposed in the first guide rail; and a link having a first end hingedly connected to the inside of the case, and a second end connected to the first guide rail and able to move in the direction of the first guide rail, wherein when the door is opened, the second end of the link moves in the direction of the first guide rail and elastically compresses the first spring.

2. The door shock absorber of claim 1, wherein the first guide rail further comprises a first stopper that controls the movement of the second end of the link when the door is opened.

3. The door shock absorber of claim 1, wherein the first guide rail further comprises a projection that allows the second end of the link to move back only when the pressure applied when the door is closed is higher than a predetermined level.

4. The door shock absorber of claim 1, further comprising a second guide rail disposed in the case, and connected to the first end of the link, the first end of the link being able to pivot and move in the direction of the second guide rail.

5. The door shock absorber of claim 4, further comprising a second spring is disposed in the second guide rail.

6. The door shock absorber of claim 5, wherein when the door is opened, the first end of the link moves in the direction of the second guide rail and elastically compresses the second spring.

7. The door shock absorber of claim 6, wherein the link has a boss on the first end of the link that includes a first diameter and a second diameter smaller than the first diameter, is the boss being inserted in the second guide rail and able to move along the second guide rail.

8. The door shock absorber of claim 1, wherein the second guide rail has a storing unit for storing the boss of the link on one side thereof, and when the door is opened, the boss pivots in the storing unit and moves in the direction of the second guide rail while the first diameter is out of the storing unit.

9. The door shock absorber of claim 7, wherein the second guide rail extends along a circular arc around a pivot axis of the door.

10. The door shock absorber of claim 7, wherein the second guide rail further comprises a second stopper that controls the movement of the first end of the link when the door is opened.

11. An image forming apparatus, comprising:

a case including a door;

means for forming an image inside the case;

a door shock absorber to absorb noise and shock when the door is opened, wherein the door shock absorber includes a first guide rail included in the door;

a first spring disposed in the first guide rail; and a link having a first end hingedly connected to the inside of the case and a second end connected to the first guide rail and able to move in the direction of the first guide rail, wherein when the door is opened, the second end of the link moves in the direction of the first guide rail and elastically compresses the first spring.

12. The image forming apparatus of claim 11, wherein the first guide rail further comprises a stopper that controls the movement of the second end of the link when the door is opened.

13. The image forming apparatus of claim 11, wherein the first guide rail further comprises a projection that allows the second end of the link to move back only when the pressure applied when the door is closed is higher than a predetermined level.

14. The image forming apparatus of claim 11, wherein the door shock absorber further comprises a second guide rail included in the case and connected to the first end of the link, the link being able to pivot and move in the direction of the second guide rail.

15. The door shock absorber of claim 14, further comprising a second spring disposed in the second guide rail, wherein when the door is opened, the second end of the link moves in the direction of the second guide rail and elastically compresses the second spring.

16. The image forming apparatus of claim 15, wherein the link has a boss on the first end of the link that includes a first diameter and a second diameter smaller than the first diameter, the boss being inserted in the second guide rail and able to move along the second guide rail.

17. The door shock absorber of claim 16, wherein the second guide rail has a storing unit for storing the first diameter of the boss on one side of the link, and when the door is opened, the boss pivots in the storing unit and moves in the direction of the pair of the second guide rail while the first diameter is out of the storing unit.

18. The image forming apparatus of claim 15, wherein the second guide rail extends along a circular arc around a pivot axis of the door.

19. The image forming apparatus of claim 15, wherein the second guide rail further comprises a stopper that controls the movement of the first end of the link when the door is opened.

20. The image forming apparatus of claim 12, wherein the first end of the link does not begin to move until the second end of the link is proximal the first stopper.

* * * * *

UNITED STATES PATENT AND TRADEMARK OFFICE

CERTIFICATE OF CORRECTION

PATENT NO. : 7,343,118 B2
APPLICATION NO. : 11/175444
DATED : March 11, 2008
INVENTOR(S) : Ahn et al.

It is certified that error appears in the above-identified patent and that said Letters Patent is hereby corrected as shown below:

Col. 7 line 57 of claim 8, the dependency is changed from “claim 1” to --claim 7--.

Col. 8 line 35 of claim 15, “The door shock absorber” is changed to --The image forming apparatus--.

Col. 8 line 38 of claim 15, “second end” is changed to --first end--.

Col. 8 line 46 of claim 17, “The door shock absorber” is changed to --The image forming apparatus--.

Col. 8 line 48 of claim 17, “one side of the link” is changed to --one side of the second guide rail--.

Signed and Sealed this

Eleventh Day of November, 2008

JON W. DUDAS
*Director of the United States Patent and Trademark Office*